United States Patent [19]

Zitelli et al.

[11] 3,956,897

[45] May 18, 1976

[54] DIGITAL TRANSFER CONTROL SYSTEM FOR DUAL MODE TURBINE OPERATION

[75] Inventors: William E. Zitelli, Media, Pa.; Leaman B. Podolsky, Wilmington, Del.

[73] Assignee: Westinghouse Electric Corporation, Pittsburgh, PA

[22] Filed: Jan. 27, 1975

[21] Appl. No.: 544,604

[52] U.S. Cl. ..... 60/660

[51] Int. Cl.[2] ..... F01K 13/02

[58] Field of Search ..... 60/660–667; 415/13, 15, 30, 17; 290/2, 4, 40

[56] References Cited

UNITED STATES PATENTS

| | | | |
|---|---|---|---|
| 3,097,488 | 7/1963 | Eggenberger et al. | 60/660 X |
| 3,097,489 | 7/1963 | Eggenberger et al. | 60/660 X |
| 3,723,018 | 3/1973 | Yoshihiro et al. | 415/30 |

*Primary Examiner*—Allen M. Ostrager
*Attorney, Agent, or Firm*—H. W. Patterson

[57] ABSTRACT

A digital transfer system for transferring the operation of a steam turbine between a single and sequential mode of operation is disclosed. A total flow demand signal is applied to all of the valves in parallel for the single mode; and applied to all of the valves through individual function generators for the sequential mode. A digital up/down counter is connected to a rate multiplier for generating pulses at a frequency corresponding to the status of the counter. An electronic switch is connected to conduct either the single or sequential mode signal to the valve operating mechanism to respond to the pulses for repetitively applying alternately the single and sequential mode signal during the transfer. Digital components both control and are controlled by the counter to increase incrementally the frequency of operation of the electronic switch to apply the particular signal toward which the transfer is being made at such increasing frequency during the first portion of the transfer period and to incrementally decrease the operating frequency of the switch and apply the particular signal from which the transfer is made during the final portion of the transfer. Provision is made to adjust the period of transfer; and to stop or reverse the transfer between modes at any period during the transfer.

18 Claims, 13 Drawing Figures

| INPUT | | | | | STATE | OUTPUT | |
|---|---|---|---|---|---|---|---|
| C | J | K | S | R | Q | Q | $\bar{Q}$ |
| ⎍ | 1 | X | 0 | 0 | 0 | 1 | 0 |
| ⎍ | 0 | X | 0 | 0 | 0 | 0 | 1 |
| ⎍ | X | 1 | 0 | 0 | 1 | 0 | 1 |
| ⎍ | X | 0 | 0 | 0 | 1 | 1 | 0 |
| X | X | X | 1 | 0 | X | 1 | 0 |
| X | X | X | 0 | 1 | X | 0 | 1 |

NOTE: EITHER 1 OR 0, 1=HIGH LEVEL SIGNAL, 0=LOW LEVEL SIGNAL

VOLTAGE REF
INPUT AMPLIFIER
POWER SUPPLY
TEST JACK
TO MECHANISM 51A

DIGITAL TRANSFER CONTROL SYSTEM FOR DUAL MODE TURBINE OPERATION

CROSS-REFERENCE TO RELATED APPLICATION

W.E. Case No. 45,810 entitled "Frequency Modulation Transfer System and Method" filed by William E. Zitelli concurrently herewith and assigned to a common assignee.

BACKGROUND OF THE INVENTION

The present invention relates broadly to a system for transferring the response of an electrically controllably mechanism from one control system to another without an abrupt change in the mechanism in accomplishing such transfer. This is particularly desirable in transferring the operation of the governor or control valves of the steam turbine between a single and sequential mode of operation.

In the single or full arc mode of operation, the valves are operated identically to control the flow of steam through a full arc of inlet nozzles to the turbine blading. In this mode, all the valves respond equally to a change in the flow demand or control signal. In the sequential or partial arc mode of operation, the valves are operated sequentially in a predetermined pattern to control the flow of steam through a partial arc of inlet nozzles to the turbine blading. In this mode, one or more valves respond differently to a change in the total flow demand or control signal.

Therefore, the valve position control signal for each of the valves when operating in the sequential mode is different than it is for each of the valves when operating in the single valve mode. To suddenly change operating modes, by switching abruptly between single and sequential control signals, could create an abrupt positional valve change that would introduce transients in the system. Such transients could possibly cause damage to the valves and/or the turbine blading.

Thus, it is desirable that a transfer from either the sequential mode or the single valve mode to the other be gradual; that is, that the value of the applied signal during the transfer gradually changes from the value of the one signal to the value of the other signal. Also, it is desirable for the mechanism, such as the valve control mechanism, for example to respond quickly to a change in either one of the control signals during such transfer without an abrupt change in the signal applied to the mechanism. A change in one of the control signals should affect the applied signal during such transfer depending on the percentage of transfer completion. Also, it is desirable that such transfer system be capable of effecting such a transfer effectively over an extended period of time, such as up to eight minutes, for example.

In U.S. Pat. Nos. 3,367,319 and 3,740,588 issued to Stratton et al, there is proposed a dual mode control system and method for changing between a single and sequential mode of valve operation. The proposed system utilizes what is termed time ratio switching for changing from one mode to another. The method used in the proposed system is to alternately switch between the two control signals at a given rate. This is accomplished by generating saw-tooth shaped pulses at a given or constant rate. A ramping voltage signal, which gradually increases throughout the transfer period, is compared with each saw-tooth waveform or pulse to produce at such given rate, a first series of output pulses that are successively greater in width, and a second series of output pulses that are successively narrower in width, until each expanding pulse is equal in duration to the repetition rate of the saw-tooth generated pulses and the narrowing pulses disappear. The width or duty cycle of each of the pulses is varied by a comparison circuit that chops each of the saw-tooth pulses at a different height in accordance with the progressively increasing ramp voltage.

A transfer system, which modulates the frequency of the generated pulses that are applied to the control mechanism, in contrast to a system where the generated pulses are varied in width or duty cycle to affect a transfer, can produce the desired results with the use of reasonable resistor and capacitor filter valves. The higher the frequency, the lesser are the component values of the filtering mechanism.

Also, a frequency modulation transfer system does not depend for reliability on a time-dependent constant-increasing voltage and its accompanying comparison circuit, which is difficult to control particularly during an extended transfer period.

SUMMARY OF THE INVENTION

The present invention relates to an improved digital system for transferring control of a steam turbine between a single and sequential mode of operation. The single and sequential control signals are normally applied through a switching means which is operated to either a first or a second condition to electrically connect one or the other of the control signals. The switching means is frequency modulated first in one direction and then the other to apply repetitively at an increasing frequency the control signal toward which the transfer is being made during the first portion of the transfer and to apply repetitively at a decreasing frequency the control signal from which the transfer is being made during the final portion of transfer. Digital circuitry including a clock and rate multiplier control the direction of frequency modulation, and the particular control signal that is being modulated in each direction. Provision is made to initiate, hold, and reverse the transfer, as well as adjust the time of the transfer.

Also, such system is applied to a turbine system where the governor valves control both the single and sequential transfer, and to a turbine system where stop valves control full arc operation and governor valves control partial arc operation.

BRIEF DESCRIPTION OF THE DRAWING

Referring to FIG. 1, there is illustrated a transfer system 10 for transferring the control of a mechanism 11 between a control signal 12 and a control signal 13. A switching mechanism 14 includes a contact 15 and a contact 16. When the contact 15 is closed a control signal is conducted from the block 12, over a conductor 17 and a conductor 18 to a filter 19 for operating the controlled mechanism 11. When the contact 16 is closed a control signal is conducted from the block 13 over a conductor 20, the switch contact 16, the conductor 18, and through the filtering mechanism 19, for operating the mechanism 11.

Figure 1:
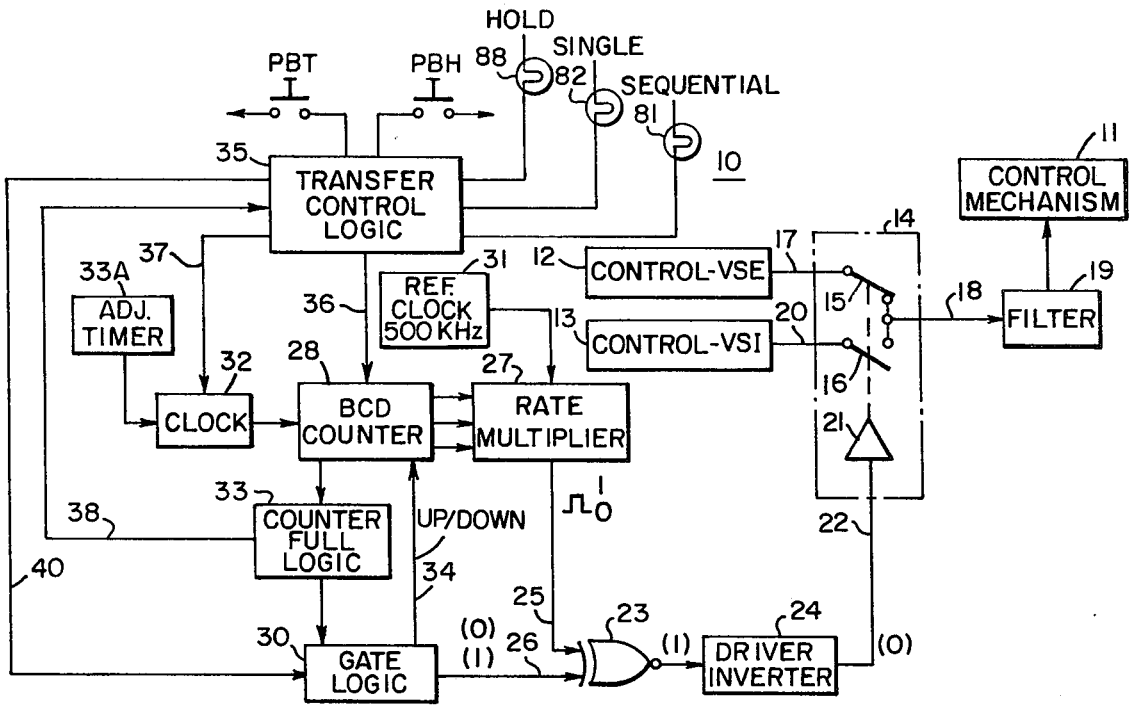
FIG. 1 is a schematic block diagram of a transfer control system according to one embodiment of the present invention.

The switching mechanism 14 is shown in the described embodiment, as being normally in the position shown in FIG. 1, when a low level digital signal is applied to its actuating mechanism 21 over a conductor 22. In response to a high level signal over the conductor 22, the actuating mechanism 21 closes the contact 16, and opens the contact 15 to transfer the response of the mechanism 11 from the control signal of the block 12 to the control signal of the block 13. In the description of the present invention, a low level signal is represented on the drawings as a (0), and the high level signal is represented as a (1). These low and high level signals which are referred to as zero and one, respectively, may be of different polarities, same polarity, or a signal of one polarity may represent a signal of one level while no signal on the conductor may represent a signal of the other level depending on the particular components and design.

An exclusive NOR gate 23 is connected to the conductor 22 of the operating mechanism 21 of the switch 14 to a driver-inverter circuit 24 for controlling the conduction of a high level or low level signal pulse for operating the switching mechanism 14. The gate 23 has two inputs referred to at 25 and 26 respectively. When both of the inputs 25 and 26 of the gate conduct either a high level signal or a low level signal simultaneously, the output of the gate 23 is a low level signal. When one of the inputs 25 or 26 is conducting a low level signal, and the other of the inputs 25 or 26 is conducting a high level signal, a high level signal appears on the output of the gate 23. This low level or high level signal, whatever the case may be, is inverted by the driver-inverter 24 to apply a signal of the opposite level to the driving mechanism 21 of the switch 14. Thus, when both of the inputs 25 and 26 are conducting signals of the same level, a high level signal is applied to the operating mechanism 21 of the switch 14. When the signals applied to the inputs 25 and 26 are of different levels, a low level signal is applied to the switch mechanism 21. The switch 14 is of the type that will follow the high and low level signals at a frequency, which in accordance with the illustrated embodiment is assumed to be at a maximum rate of approximately 500 kilohertz. Although, a switch that is capable of responding to a much lower maximum frequency may be used, higher frequency permits a much faster response to any changes in the control signal during a transfer. Although, the switch 14 illustrates a contact 15 and a contact 16, it is understood that switches not having mechanical contacts are actually used.

A rate multiplier 27 generates high level pulses at the input 25 of the gate 23 at a frequency that is determined by a binary coded counter 28. Digital gating logic referred to at block 30 determines the presence of either a high level or a low level pulse at the input 26 of the gate 23. The rate multiplier 27 includes a reference clock 31, which in the described embodiment, is capable of operating the rate multiplier to produce output pulses at a maximum rate of 500 kilohertz. The binary counter 28 is connected to the rate multiplier to control the frequency of the output pulses in accordance with the binary count which is present in the counter 28. A clock 32 is provided to control the counting rate of the counter 28. An adjustable timer referred to at block 33 controls the rate of the clock 32. In the described embodiment it is contemplated that the adjustable timer may be operated to vary the rate of the clock 32 so that the counter 38 is operated incrementally at a rate that results in the output frequency of the rate multiplier 27 to modulate between a minimum and maximum frequency during a period of time that may vary anywhere from one and a half to four minutes for example. Thus, as will be more fully described hereinafter, the total transfer time may be varied from three minutes to eight minutes, for example.

The gating logic 30 is controlled by what may be termed counter full logic referred to at block 33 and transfer control logic referred to at block 34 in controlling the level of the output pulse on the input 26 of the gate 23; and to control the direction of operation of counter 28; that is, whether or not the counter is to count in sequence upwardly or downwardly by way of the up/down input 34. The transfer control logic referred as block 35 is controlled to commence the transfer by operation of the pushbutton PBT; and controlled to "hold" or stop the transfer by means of the pushbutton PBH. The transfer control logic 35 also resets the counter 28 by way of output 36 and starts and stops the operation of the clock 32 over output 37. The counter full logic 33 controls over output 38 the transfer control logic 35 to stop the clock 32 upon the completion of a transfer. The transfer control logic 35 also controls the gate logic 30 over output 40 in accordance with the direction in which a transfer is to be made in response to the operation of the pushbutton PBT.

Assuming that the control mechanism 11 is responding to a control signal from the block 12 through the closed contact 15 of the switch 14, the operation of the pushbutton PBT initiates a transfer of a predetermined duration until the control mechanism 11 is responding to the control signal from the block 13 through the closed contact 16 of the switch 14. To initiate a transfer, the operator depresses the pushbutton PBT which causes the transfer control logic 35 to start the operation of the clock 32 for operating the counter 28. The counter 28 operates at a rate determined by the speed of the clock 32, which is manually adjustable by the timer 33. In response to each binary count of the counter 28, the rate multiplier 27 varies the frequency of the output pulses on line 25. For example, when the BCD counter 28 counts a "one", the rate multiplier produces output pulses at a rate that is 1/1000 of the maximum clock rate of the rate multiplier 27; in other words at a rate of 500 hertz. In response to the count of "two" the rate multiplier produces pulses at a rate of 1 kilohertz. This continues incrementally in accordance with the count of the counter 28 until the rate multiplier is producing an output of 999/1000 of the maximum clock rate or 499,500 hertz, which corresponds to the maximum count of 999 from the counter 28.

In response to each pulse from the rate multiplier 27, the gate 23 conducts to cause the driver-inverter 24 to operate the switch 14 through its mechanism 21, so that the contact 16 closes and the contact 15 opens, at the same frequency as the output pulses of the rate multiplier 27, which applies pulses having the same frequency, and a peak to base value corresponding to the difference between the control signals.

Figure 2:
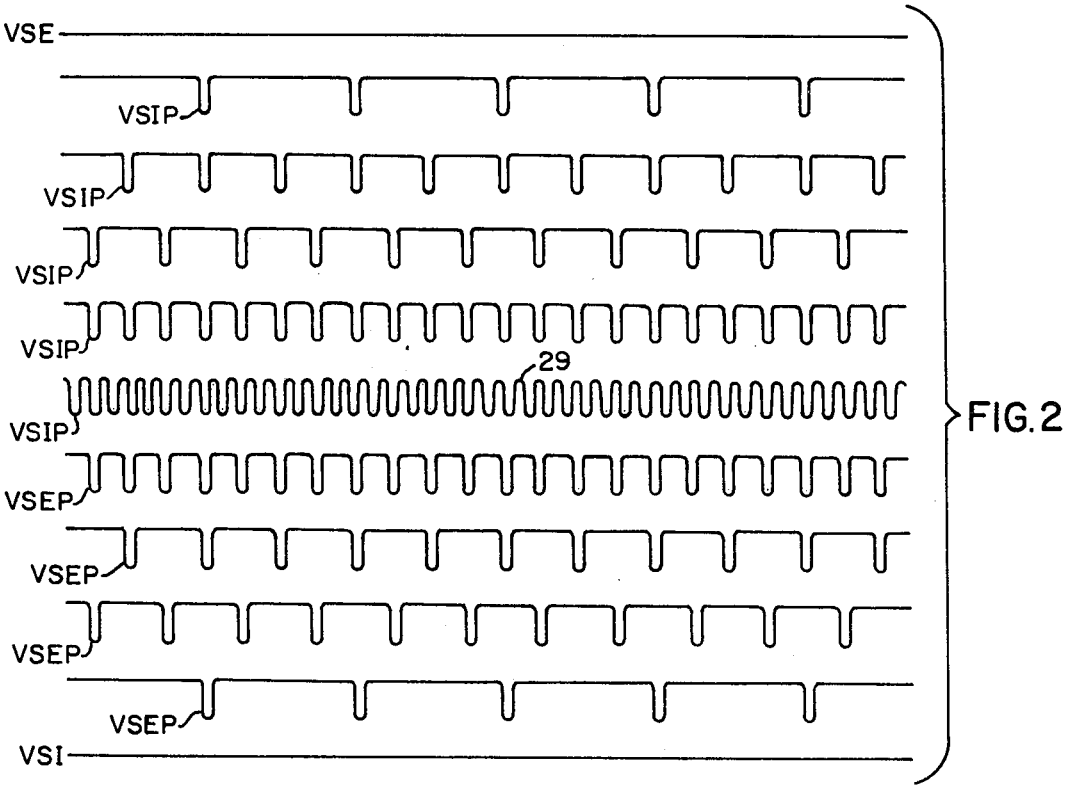
FIG. 2 is a series of waveforms which illustrate the frequency modulation of the single and sequential control signal transfer pulses.

Referring to FIG. 2, straight line VSI represents one of the control signals and VSE represents the other control signal. The pulses which are applied to the filter 19, as represented by the lines between VSI and VSE have peaks VSIP and VSEP, which correspond in value to the respective control signals VSI and VSE. Pulse train referred to at 29 represents the maximum frequency or count midway in the transfer, at which point, the peaks of each of the pulses are switched, so that they correspond in value to the other control signal. When a transfer is occurring from control signal VSE (12) to control signal VSI (13) the pulses VSIP are increasing in frequency toward the train 29, and the pulses VSEP are decreasing from the train 29. When a transfer is made from VSI to signal VSE, the pulses VSEP are increasing in frequency to the line 29, and the pulses VSIP are decreasing in frequency. Thus, as the frequency increases, the filter 19 averages the pulses of the signal toward which the transfer is being made with the control signal from which the transfer is being made and as the frequency decreases, the filter 19 averages the pulses of the signal from which the transfer is being made with the control signal toward which the transfer is made.

Figures 3, 5:
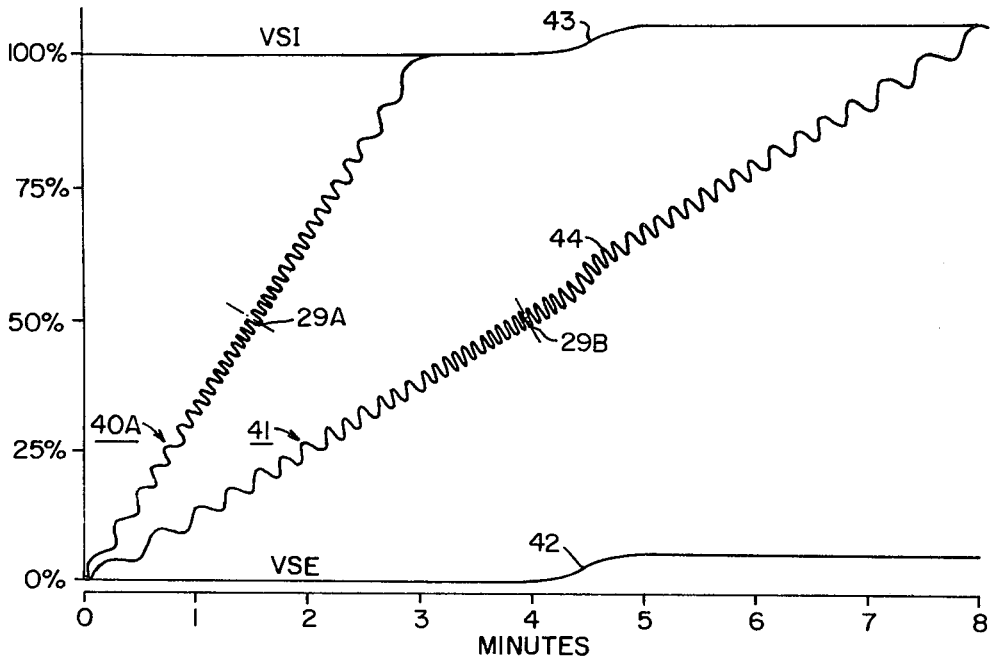
FIG. 3 illustrates graphically the gradual change in the value of the control signal during a transfer in accordance with the modulation of the pulses in both an increasing and decreasing direction.
FIG. 5 is a block diagram of the state of the output terminals for applied pulses under various input terminal conditions of the flip-flop circuit components utilized in the circuit diagram of FIG. 4.

Referring to FIG. 3, the ordinate represents the percentage of transfer completion between a control signal VSE and a control signal VSI. The abscissa represents the number of minutes required to effect the transfer. A line 40 represents the filter 19 output in greatly expanded form for a transfer from signal VSE to VSI over a three minute period. At point 29A, where the maximum frequency occurs, the signal level is approximately midway in value between the two control signals. As the frequency decreases, the output of the filter continues to increase in value until the signal level corresponds to the signal VSI.

A line 41 of FIG. 3 represents the filter 19 output in greatly expanded form for a transfer from signal VSE to VSI over a period of 8 minutes. Curve portions 42 and 43 represent grossly an increase in the value of control signal VSE and VSI during the transfer; and a curve portion 44 represents grossly a corresponding change in the output level of the filter 19 caused by such change. Such a change in the control signals would typically be caused by a change in the total flow demand for the embodiment described.

Referring again to FIG. 1, in response to the maximum count of the counter 28, the counter full logic 33 is operated to 15 is the gating logic to operate the counter 28 in a reverse direction and simultaneously govern the gating logic 30 to provide a low level signal on the input 26 of the exclusive NOR gate 23. In response to each incremental count in a downward direction of the counter 28, the output pulses of the rate multiplier 27 decrease. However, because the gate 23 has a low level signal on its input 26, it conducts a high level pulse in response to each output pulse of the rate multiplier 27. The high level pulse is inverted by the inverter 24, which provides a low level pulse in response to each output pulse from the rate multiplier 27. Thus, the contact 15 of the switch 14 is closed at a frequency rate corresponding to the output rate of the rate multiplier 27 to modulate the control signal VSE from the block 12 in incrementally decreasing steps. The decreasing frequency of the pulses from the control signal VSI of block 12 produces an average output from the filter 19, which continues in a direction toward the control signal VSI and away from the control signal VSE as shown in FIG. 3.

When the counter reaches zero after counting in a downward direction from its maximum count, the counter full logic 33 governs the transfer control logic 35 to stop the operation of the clock 32. This results in a steady low level signal conducted to the input 25 of the gate 23. This, in turn, provides a high level steady signal from the switch actuating mechanism 21 to maintain the switch 14 in a position with its contact 16 closed. The control mechanism 11 is now responding to the level of the signal from the block 13.

To transfer the response of the control mechanism 11 from the signal VSI of the block 13 back to the signal VSE of the block 12, the operator depresses the push-button PBT, which starts the operation of the clock 32, and controls the gate logic 30 to drive the counter 28 to commence counting in an upward direction. The input 26 of the gate 23 continues to conduct a low level signal, which causes the contact 15 to close at the same frequency as the output multiplier 27 in the same manner as described previously. As the contact closure 15 is modulated in an increasing manner, the output of the filter 19 averages the signal toward the signal VSE from the block 12, until the maximum frequency is obtained. In response to the maximum count of the counter 28, the counter full logic 33 controls the gate logic 30 to cause the counter 28 to count downwardly and simultaneously to conduct a high level signal on the input 26 of the gate 23. Thus, the contact 16 closes in response to each output pulse, to cause the filter 19 to continue averaging the transfer signal in a direction towards the signal VSE from the source 12. This continues, as shown in FIG. 3, until the counter reaches zero at which time the contact 15 remains stationary in its closed position. This completes the transfer from the signal source 13 to the signal source 12, and the control mechanism 11 continues to respond to the signal VSE.

To stop the transfer intermediate its beginning and end, regardless of the direction of the transfer taking place, the operator depresses the button PBH which operates the transfer control logic 35 to inhibit or stop the operation of the clock 32. In this condition, the rate multiplier can continue to generate pulses at the appropriate frequency, depending upon the count which is stored in the counter, at the time the transfer stops. Thus, the switch 14 follows the frequency at the constant or given rate to maintain the output signal from the filter 19 at the level existing at the time of the clock stoppage. To again commence the transfer, after stopping at some point intermediate the beginning and the end, the operator again depresses the pushbutton PBH which starts the clock 32; and the transfer continues in the same manner as previously described.

To reverse the direction of transfer prior to the completion, thereof, the operator may either depress the pushbutton PBH, and then depress the pushbutton PBT, or merely operate the pushbutton PBT. In response to the operation of the pushbutton PBT, the transfer control logic is operated to reverse the direction of the counter 28 and to change the signal level on the input 26 to the gate 23 at the appropriate time in the control cycle as initiated by the gate logic 30. As previously described, this causes the opposite contact of the switch 14 to close in response to either the increasing or decreasing frequency of the pulses of the rate multiplier 27, depending on the operating condition of the system at the time the pushbutton PBT is depressed.

Figure 4A:
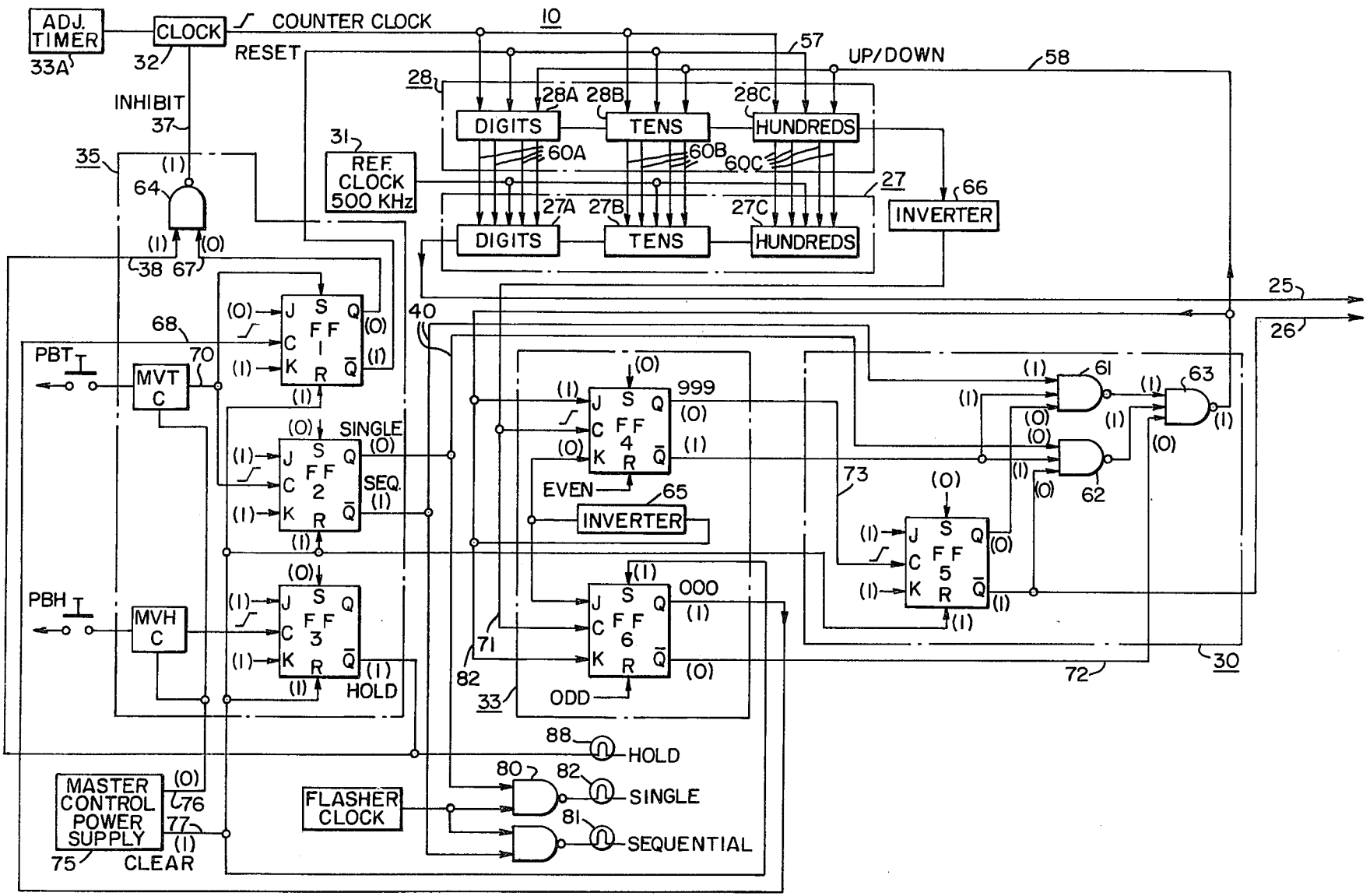
FIGS. 4A and 4B are schematic circuit diagrams of a control system for transferring the operation of a plurality of valves between a single and sequential control signal in accordance with one embodiment of the present invention.
Figure 4B:
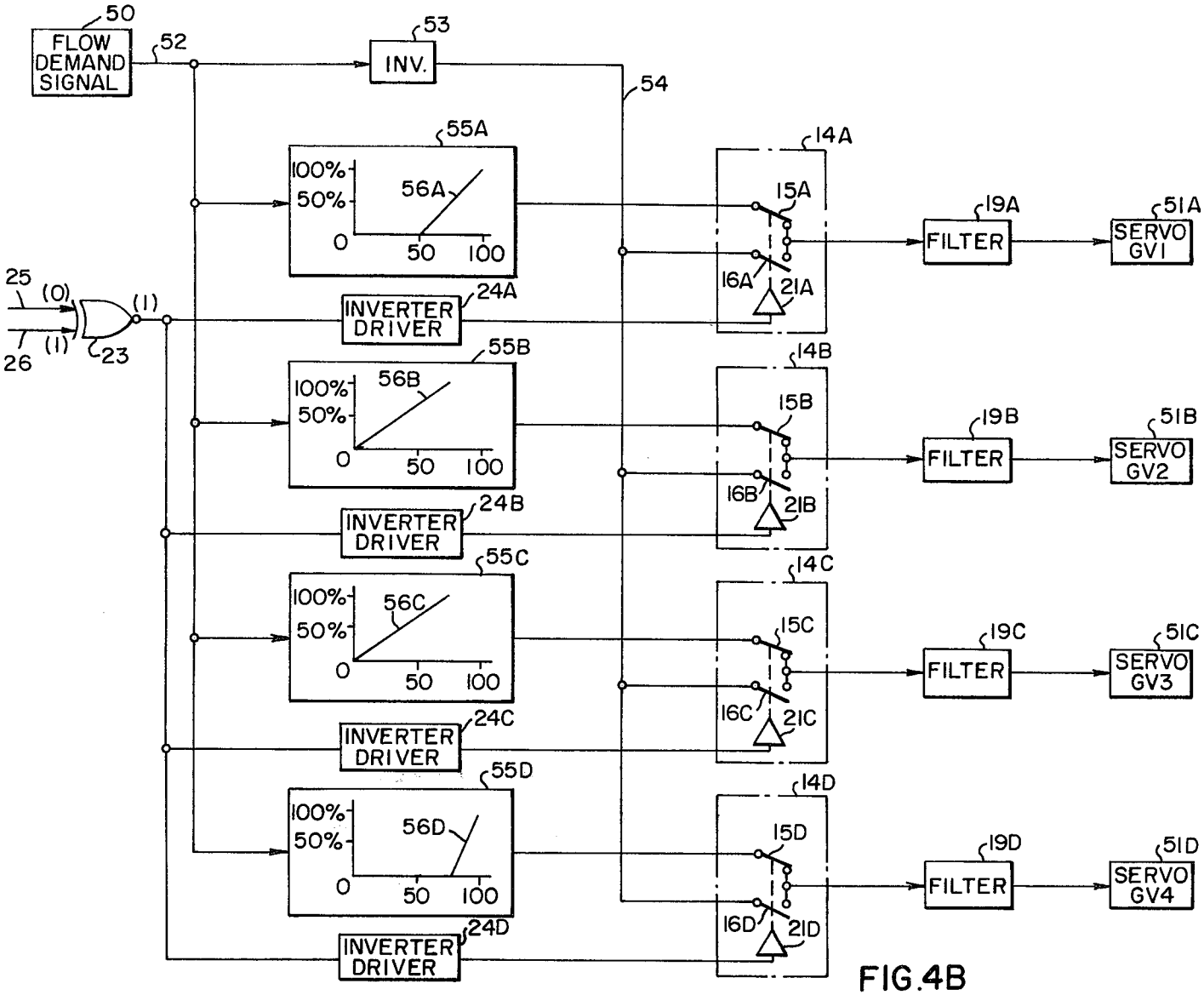

Referring to FIG. 4, which illustrates in more detail the transfer control portion of the system described in connection with FIG. 1, particularly shows such transfer control system for transferring the control of a plurality of governor valves in a steam turbine between a single and sequential mode of operation. A flow demand or reference signal as referred to at block 50 can be varied in any well known manner in accordance with the desired operation of the turbine. This signal source may be a load demand signal, or any other suitable demand reference signal in accordance with the particular turbine control system in which the transfer system is used. For single valve operation, the plurality of governor valves and their servo mechanisms, which are referred to at block 51A, 51B, 51C, and 51D, are all operated in an identical manner in response to a reference or demand signal from the source 50. A signal is conducted over line 52, an inverter 53, and a conductor 54 to a respective associated switch referred at 14A, 14B, 14C, and 14D respectively. A signal on the line 54 is conducted through the closed contact 16A, and the filter 19A, for the valve 51A; through the closed contact 16B and the filter 19B for the valve 51B; and through the closed contact 16C and the filter 19C, for the valve 51C; and through the closed contact 16D and the filter 19D for the valve 51D. The switches 14A, 14B, 14C, and 14D are operated in the same manner as the switch mechanism 14 referred to in FIG. 1. These switches may be of any suitable type which will follow the required frequency; and particularly may be of the well known two-channel junction-type field effect transistorized switches designed to function as single pole, single throw electronic switches. These switches have level shifting drivers that enable low level inputs to control the on-off state of each switch. The switch driver may be designed to provide a turn-off speed which is faster than the turn-on speed so that a break-before make action is achieved when switching from one channel to another.

To operate the system in a sequential mode, a signal from the signal source 50 is conducted over the line 52 to a plurality of function generators 55A, 55B, 55C, and 55D. The output of each of the function generators is connected to a contact 15A, 15B, 15C, and 15D, respectively.

As shown by curve 56A in FIG. 4 of the block representing the function generator 55A, the valve 51A, in the sequential mode, does not begin to open until the flow demand signal is approximately 50% of its maximum value; and also controls the valve position at flows above the 50% level as illustrated by the curve 56A. The valves 51B and 51C begin to open as soon as a flow demand signal is present as shown by curves 56B and 56C in the respective blocks of the function generators 55B and 55C. The valve 51D does not begin to open until the steam flow demand signal approximates 75% of the maximum steam flow as shown by curve 56D of the block 55D. The valves represented by blocks 51B and 51C, which begin to open immediately in response to a flow demand signal have a lift position which is approximately 25% of their maximum flow-open position as shown by the curves 56B and 56C, at the time that valve 51A begins to open. At approximately 75% flow, the valve 51A is almost completely open, and 51B, and 51C are completely open as shown by the curves 56A, 56B, and 56C of their respective function generators. The valve 51D is just beginning to open as shown by the curve 56D. Therefore, it is apparent that the signal level at the output of each of the function generators may be different depending upon the value of the flow demand signal from the source 50. The characteristics of each of the function generators are assumed to be fixed; and will operate their respective valve mechanisms only when the associated respective switch contact 15A to 15B is closed. The driver for each of the switches 14A through 14B is referred to at 21A through 21B respectively. The drivers are connected to the output of the exclusive NOR gate 23 and conducted through an driver-inverter 24A through 24D to invert the signal at the output as described in connection with FIG. 1. The function generators 55A through 55B may be any well known operational amplifier having the required gain for various input voltages, such as a monolithic instrumentation operational amplifier utilizing solid-state devices, for example.

For ease of understanding, the various components described in detail in FIG. 4, are enclosed by dashed lines bearing the same reference numerals as corresponding blocks of the functional block diagram of FIG. 1.

The binary coded decimal counter 28 includes a digit module 28A, a tens module 28B and a hundreds module 28C, so that the clock 28 is capable of producing a binary count from the numeral 1 to numeral 999. The counter 28 is reset to zero in response to the application of a high level voltage pulse on an input 57; and the direction of count is determined by either a high level or low level signal on its input 58. The BCD up/down counter 28 may be any well known type which responds to a series of input signals to produce a binary coded decimal output count on the occurrence of each successive input signal.

The BCD rate multiplier 27 includes a digit module 27A connected to output terminals 60A of the counter digit module 28A; a tens module 27B connected to output terminals 60B of the counter module 28B; and a hundreds module 27C connected to the output of the counter module 28C. The rate multiplier 27 may be of the well known type that provides an output pulse rate based upon the binary coded decimal input number from a counter, such as the counter 28. The rate of the pulses generated by the rate multiplier 27 over its output 25 is also determined by the reference clock 31. As previously mentioned, the reference clock 31 constantly produces pulses at a rate of 500 KHz or in other words 500,000 pulses per second. When the digit 1 is output from the counter 28, the pulse rate is equal to 1 divided by 1,000 times five hundred thousand, or in other words, 500 pulses per second. When the counter 28 inputs to the rate multiplier 27 a binary number corresponding to 15, for example, the number of pulses generated by the rate multiplier is seventy five hundred pulses per second. Thus, each incremental change in the counter 28, in the described embodiment, changes the frequency rate of the multiplier 28 by 500 hertz. Thus, when the count in the counter 28 reaches 999, the frequency rate of the multiplier is 499,500 pulses per second. The rate at which the output pulses are modulated, or in other words, the rate at which the counter 28 incrementally changes from one count to another is determined by the operating frequency of the clock 32. The frequency of clock 32 can be varied by the adjustable timer 33 to provide for a transfer time of anywhere from 3 to 8 minutes, for example. For a transfer time of 3 minutes, clock 32 generates 2,000 pulses during the 3 minute period. For a transfer time of 8 minutes, the clock 32 would generate the 2,000 pulses, required for the entire transfer, in the 8 minute period.

The transfer control logic 34, the counter full logic 33, and the gate logic 30 include a plurality of multivibrators referred to as FF1 to FF6 inclusive. Each of the flip-flop circuits of the present embodiment are of conventional construction and are of the well known type, commonly referred to as J-K flip-flop circuits of the type manufactured by RCA, for example. Each flip-flop circuit has input terminals for individual high or low level input signals; and has output terminals Q and $\overline{Q}$ that conduct either a high or a low level signal depending upon the level of the signal applied to the various input terminals. The input terminals for the flip-flop circuits FF1 through FF6 are commonly referred to in FIG. 4 as S, J, C, K, and R. Referring to the table of FIG. 5, the output terminals Q and $\overline{Q}$ can be determined in accordance with the high or low level signals applied to the various input terminals. For example, as shown in the first horizontal column of the table FIG. 5, a low to high level signal applied to the flip-flop input terminal C, at times when a high level signal is applied to the J input terminal, a low level signal is applied to the input terminals S and R, and the output terminal Q is conducting a low level signal; the flip-flop switches such that the output terminal Q conducts a high level signal and the output terminal $\overline{Q}$ conducts a low level signal. Referring to the second horizontal column of FIG. 5, a low to high level pulse on the input C when the output terminals Q and $\overline{Q}$ are conducting a low level and a high level signal respectively, does not result in a switching of the flip-flop at times when the input terminals J, S, and R have a low level signal applied thereto. The remaining conditions of operation of the flip-flop circuit of FF1 through FF6 are evident from the table of FIG. 5 and will be described in detail in connection with the description of the operation of the system in so face as is necessary for an understanding of the invention.

The gate control logic within the dash lines referred to at 30 of FIG. 4 also includes NAND gates 61, 62, and 63. Each of the NAND gates includes three input terminals and an output terminal. Each NAND gate may be of the well known type that conducts a high level signal when none of the input terminals are of the same level; and conducts a low level signal when the same high level signal is applied to all of the input terminals. A NAND gate 64 is included in that portion of the system within dashed line 35 that includes two input terminals; and operates so that a high level signal is produced at its output 37 when signals of different levels are applied to both of its inputs. When signals of the same high level are applied to its input terminals, the NAND gate 64 conducts a low level signal. The transfer control logic 38 also includes well known conventional monostable multivibrators referred to as MVT and MVH, which produce a high level output pulse of a predetermined duration in response to the operation of its respective pushbutton PBT and PBH. Inverters 65 and 66 merely serve to change a normal high level pulse into a low level pulse, and a low level pulse into a high level pulse.

The flip-flop circuit FF1 controls the state of input terminal 67 to the NAND gate 64, and the reset input 57, to reset the counter 28 to zero. The circuit FF1 is controlled by a low to high level signal applied to its terminal C from the output terminal Q of the flip-flop FF6 over input line 68; and is also controlled by the operation of the one shot multivibrator MVT over line 70 which is connected to its input terminal S. The flip-flop circuit FF2 controls the condition of one of the inputs to the NAND gate 61, and one of the inputs to the NAND gate 62 over the output lines 40 from the terminals $\overline{Q}$ and Q, respectively in response to a high level pulse on the input terminal C from the multivibrator MVT. A flip-flop circuit FF3 controls the input 38 to the NAND gate 64 in conjunction with FF1 to either start or inhibit the operation of the clock 32 depending upon the operation of the pushbutton PBT or PBH. The output terminal Q of FF3 is not utilized in the present embodiment and $\overline{Q}$ merely switches between a low level and a high level output signal in response to an input pulse at terminal C from the multivibrator MVH.

The flip-flop circuit FF4 in the counter full logic portion 33 responds to a low to high level pulse applied to its input C over line 71 from the output of the inverter 66 from the accumulator or counter portion 28C; and is arranged so that its output terminal Q and $\overline{Q}$ switch between high and low level signals in response to a binary count of 999 from the counter 28. The flip-flop circuit FF6 switches its output terminals Q and $\overline{Q}$ from one state to another in response to a high level pulse on its input terminal C from the line 71 in response to a zero count from the counter 28. In response to such switching, FF6 operates FF1 to stop the operation of the clock 32 through the NAND gate 64. Also, the output $\overline{Q}$ of FF6 governs the condition of one of the input terminals of the NAND gate 63 over line 72.

The flip-flop circuit FF5 in the gate logic portion 30 of the system operates to change the output level of its terminals Q and $\overline{Q}$ in response to a signal that is applied to input C over line 73 upon the occurrence of a count of 999 as described in connection with FF4. Also, the signal from the output $\overline{Q}$ of FF5 controls the high or low level of the input terminal 26 of the exclusive NOR gate 23 described in connection with FIG. 1. The NAND gates 61, 62 and 63 determine the direction of counting of the counter 28.

Figure 6A:
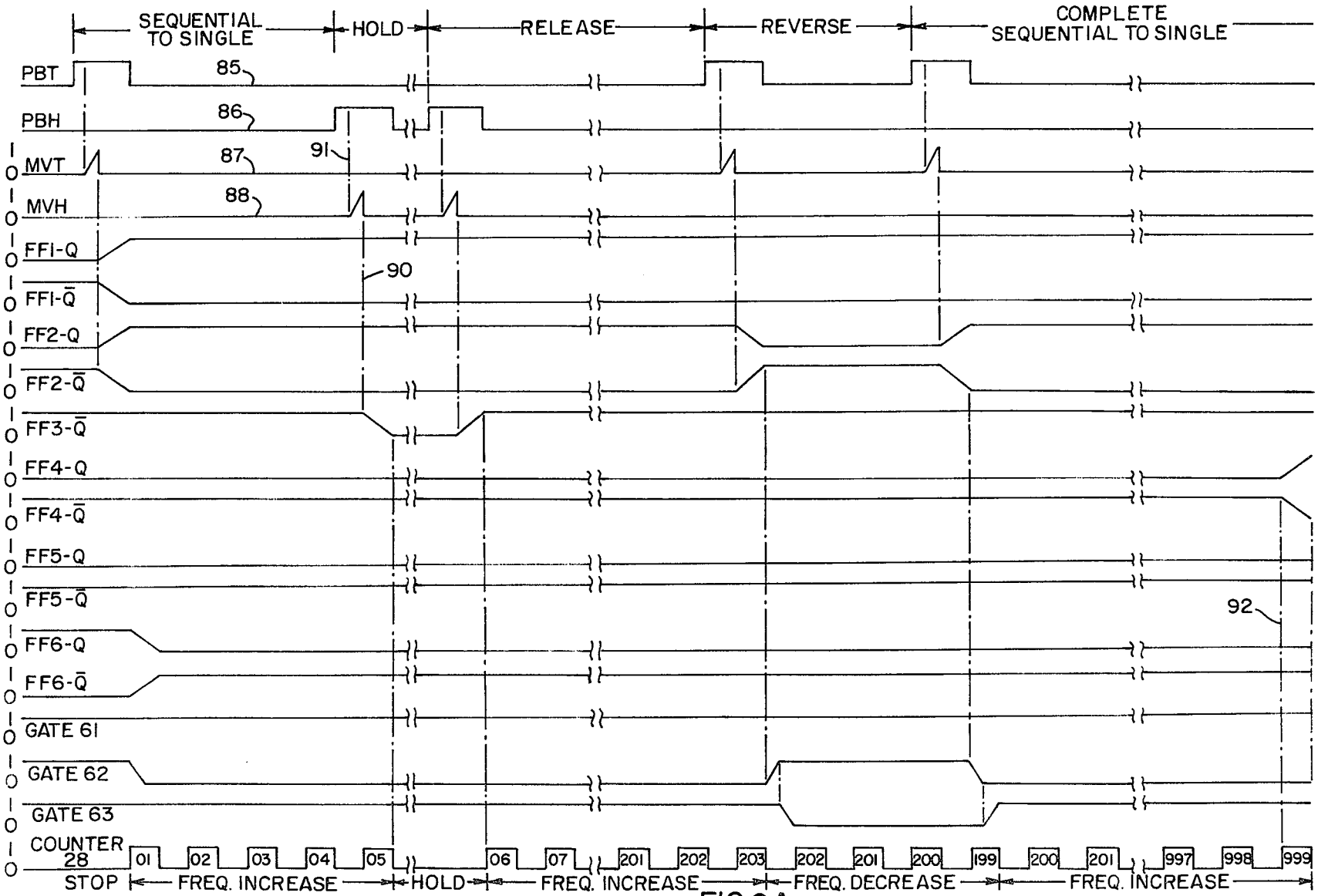
FIGS. 6A and 6B are timing diagrams illustrating the state of the digital counter and the digital output signals for the various flip-flop circuit components and gates in the transfer control system of FIG. 4.
Figure 6B:
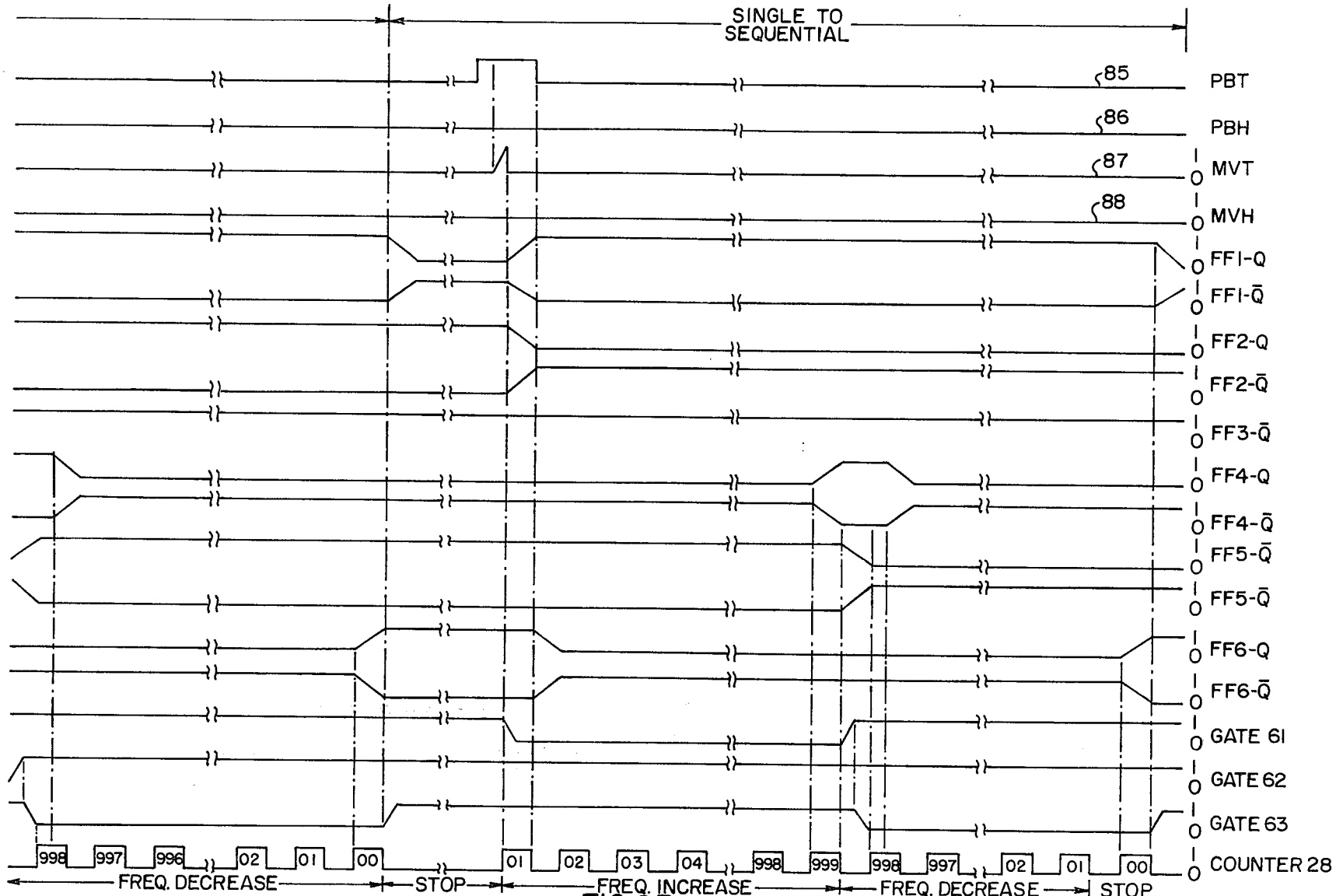

A master control power supply 75 generates a low level signal at its output 76 and a high level signal at its output signal 77 when the electrical power is first turned on. The low level signal at output 76 insures that the multivibrators MVT and MVH do not generate a pulse in response to the initial application of power. Also, the output 77 is connected to the input terminals R of the flip-flop circuits FF1, FF2, FF3, and FF5 so that they will be in the proper condition for starting a transfer. FIG. 4 includes a (1) or (0) adjacent the input and output terminals of the various flip-flop circuits, gates, and counters in the system. These reference numerals (0) and (1) represent the type of digital signal; that is, either a low level or a high level signal, that is present, or applied to the associated component when the system is first turned on. The system is illustrated in its quiescent state with the valves 51A through 51D being operated in the sequential mode through the closed contacts 15A through 15D effectively. Such a normal state is considered preferable, in view of the fact that the need to transfer from one mode of operation to another usually occurs when the valves are operating in their sequential mode. However, the system could be so arranged so that the transfer system would normally provide for operation of the valves in a single valve mode when the power is first turned on the system. FIG. 6, shows the various conditions of the flip-flop circuits and the gates during the operation of the system; and may be referred to for a more detailed understanding of the conditions of the components at any period of time during the transfer. A more detailed description of the various components of the system will be given in connection with the description of its operation.

When the system is turned on, the high voltage level applied to the reset input R of the flip-flop circuits FF1, FF2, FF3, FF5 and applied to the set input S of the flip-flop FF6 insures that the condition of these flip-flops are such that, with the exception of the output and $\overline{Q}$ of FF6, the outputs Q and $\overline{Q}$ are all conducting a low and a high level signal respectively. With the flip-flop circuits FF1 through FF6 in the condition shown, a lamp 81 is illuminated which indicates to the operator that the system is in the sequential mode. Also, inputs 67 and 38 of the NAND gate 64 have applied a low level and a high level signal, respectively, which prevents the clock 32 from running. The outputs Q and $\overline{Q}$ of FF2 are in a low and high level condition respectively for conditioning the gates 61 and 62.

The output of the gate 63 is a high level signal which controls the counter 28 to count upwardly in response to the beginning of the transfer operation. This high level signal is also applied to an input 82 for the flip-flop circuits FF4 and FF6, so that the input terminals J and K are in such a condition, that FF4 responds to a high level pulse upon the count of 999 of the counter 28, and FF6 responds to a zero count of the counter 28. The flip-flop FF5 applies a high level input pulse to the gate 23 so that the contacts 15A through 15D are closed when the rate multiplier output 25 to the input of the gate 23 is in a quiescent or low level condition.

Referring to FIG. 6, which has been included in this specification to provide an understanding of the condition of the various digital components of the transfer system under different operating condition, the operation of the pushbutton PBT and PBH is represented by elevated portions of horizontal lines 85 and 86, respectively. The operation of the monostable vibrators MVT and MVH in response to the operation of its associated pushbutton PBT and PBH are represented by elevated portions of horizontal lines 87 and 88. The levels of the output signals for terminals Q and $\overline{Q}$ of the flip-flop circuits FF1 through FF6 are represented by the appropriately labeled horizontal lines; and the signal level for each such horizontal line as indicated by the reference (1) and (0) at the extreme ends thereof for a high and low level signal output, respectively. Similarly, the output signal level for gates 61, 62 and 63 are represented by the appropriately labeled horizontal lines with the reference numerals (1) and (0) at the extreme ends thereof, to indicate a high or low level signal, respectively. The condition of the counter 28 is shown by the appropriately labeled horizontal line with the particular count of such counter being indicated by the numerals within each elevated portion thereof.

The dashed lines in FIG. 6 indicate the cooperation of the various components with the arrows on such dashed lines indicating the direction of control between components. By way of example, dashed line 90 indicates that the output terminal $\overline{Q}$ of FF3 is switched from a high level to a low level signal in response to the operation of the multivibrator MVH; and the multivibrator MVH response is indicated by dashed line 91 commencing at the elevated portion of the horizontal line representing the operation of the button PBH. Also, dashed line 92 indicates that the occurrence of the count 999 governs the flip-flop circuit FF4 to change the level of the signal conducted by its output terminals $\overline{Q}$ from a high level to a low level signal.

To transfer from the sequential to the single mode of operation, the operator adjusts the timer 33 to determine the total amount of transfer time, which is described as being any where from 3 to 8 minutes; but may be shorter or longer for installations where such a transfer time is desired. He then operates the transfer pushbutton PBT which causes the one shot multivibrator MVT to generate at its output 70 a pulse, which is applied to the input S of FF2, and also to the input S of FF1. The high level input to FF1 causes output Q to change to a high level signal, and $\overline{Q}$ to change to a low level signal. The high level signal on Q of FF1 removes the inhibit signal from the clock 32, and removes the reset signal from the counter 28 to start the operation of the counter.

Simultaneously, the outputs Q and $\overline{Q}$ of FF2 change to conduct to a high level and a low level signal respectively, which illuminates a lamp 82 and extinguishes the lamp 81 informing the operator that a transfer is being made toward the single mode. Also, the outputs Q and $\overline{Q}$ of FF2 which are input over conductor 40 to gates 61 and 62 change to a low and a high level signal respectively. This has no effect on the high level signal at the output of gate C but conditions the system for reversal to a sequential mode of operation either intermediate or at the end of the transfer to the single mode.

As the counter 28 is counting upwardly from one to 999, the frequency of the pulses from the rate multiplier occurring on output 25 is increasing from 1/500 kilohertz to 500 kilohertz incrementally, as described in connection with FIG. 1. The exclusive NOR gate 23 conducts at this frequency, which causes each of the switches 14A through 14D to open and close their contacts 16A at the same frequency. Since the switch 14 operates to close its contacts 16A in response to each high level pulse, the signal from the source 50 on line 52 is averaged with the sequential signal that is conducted through contact 15A at an ever increasing rate. The filter 19A averages these pulses, which alternately are conducted through the closed contacts 16A and 15A, which causes the output signal from the filter 19 to gradually change toward the level of the single mode control signal VSI as shown in FIG. 3. When the counter 28 reaches a binary code equivalent to 999, an output pulse from the counter is applied to the input C over line 71 to FF4. Because at this point in the transfer, a high level pulse is applied to the J input, and a low level pulse is applied to the K input of FF4, the output Q of FF4 changes to a high level pulse which is input over line 73 to FF5. The flip-flop FF5 changes its output terminals Q and $\overline{Q}$ to a high level and low level signal respectively, which causes the gates 61 and 62 to conduct a low level output signal to the input of the gate 63. The gate 63 in turn conducts a low level signal which directs the counter 28 to commence counting downwardly. The output $\overline{Q}$ of FF5 is now a low level signal which results in the switches 14A through 14D being operated so that their respective contacts 15A through 15D close at a frequency corresponding to the output frequency from the rate multiplier 27. In this portion of the transfer less and less of the sequential signal VSE is being averaged with the single mode control signal VSI, and the resulting output of the filter continues toward the level of the single mode control signal VSI as shown in FIG. 3.

Thus, the control signal toward which a transfer is being made is being averaged with the signal from which the transfer is being made during the first portion of the transfer period until the counter reaches its maximum count. As the frequency of the closing of the contacts 16A through 16D increases, more and more of the signal is being averaged with the signal from which the transfer is being made. When the frequency is decreasing, the contacts 15A through 15D close at the same frequency; and less and less of the sequential mode signal VSE is being averaged and resulting signal from the output of each respective filter 19 moves closer and closer to the signal toward which such transfer is being made.

When the counter 28 reaches zero, the output Q of FF6 responds to a high level pulse over input 71 to its terminal C, and it switches from a low level to a high level pulse to apply a high level pulse to the line 37 for stopping the clock 32. Also, the output $\overline{Q}$ of FF6 switches to a low level signal which causes the input 72 to the gate 63 to change to a low level signal pulse which causes the gate 63 to conduct a high level signal pulse for preparing the counter 28 to count upwardly during the next transfer period. The output $\overline{Q}$ of FF5 is still conducting at a low level signal so that, at the end of the transfer to the single mode the switches 16A to 16D are all in a closed condition; and thus, the valve mechanisms 51A through 51D are responding to the flow demand signal over the line 52, the inverter 53, and line 54.

To transfer from the single mode back to the sequential mode of operation, the pushbutton PBT is again depressed, which operates the flip-flops FF1 and FF2 to start the clock 32, and to change the condition of the inputs over contacts 40 to the gates 61 and 62 in preparation for the next transfer back to the single valve mode. Also, the lamp 82 is extinguished and the lamp 81 is illuminated to indicate to the operator that a transfer is being made toward the sequential mode. The condition of the flip-flop FF5 with respect to its outputs Q and $\overline{Q}$ are the same during the first portion of the transfer from the single mode VSI to the sequential mode VSE as they were during the last portion of the transfer from the sequential to the single mode. Thus, the contacts 15A through 15D of the switches 14A through 14D will close at the increasing frequency to cause the filters 19A through 19D to average more and more of the sequential signal VSE with the single mode signal VSI until the maximum count is reached. When the counter reaches the count of 999, the flip-flop FF5 is operated so that its $\overline{Q}$ output becomes a low level signal in response to an input signal on line 73 from FF4 in the manner as previously described. This results in a high level signal being applied to the drivers 21A through 21D of the switches 14A through 14D, such that contacts 16A through 16D close at a decreasing frequency, to average less and less of the single mode signal VSI with the sequential mode signal VSE in the manner as previously described. When the counter reaches zero the contacts 15A through 15D remain in a closed position in response to the stopping of the clock 32 as caused by the operation of the flip-flop FF1 in response to the switching of the Q output of FF6 from a low level to a high level signal. The output $\overline{Q}$ of FF6 and the output of Q of FF5 prepare the gates 61, 62 and 63 for a subsequent transfer toward the single valve mode.

In the event that the operator desires to stop the transfer intermediate the beginning or the end, the pushbutton PBH is depressed, which switches the output $\overline{Q}$ of FF3 to a low level signal which in turn illuminates lamp 88 to inform the operator that the system is in a "hold" condition and simultaneously changes the input 38 to the gate 64 for stopping the operation of the clock 32. The system may operate indefinitely in this condition, and the valves 51A through 51B will respond to the filtered signal at whatever level it receives in accordance with the particular frequency being applied to the switches 14A through 14B at the time the clock 32 is stopped. To continue the operation, the pushbutton PBH is again depressed which operates FF3 so that its output $\overline{Q}$ conducts a high level signal on line 38 which causes the gate 64 to conduct a low level signal and the clock 32 begins driving the counter 28 to continue the transfer.

The direction of transfer can be reversed at any time after it is commenced and before it is completed by depressing the pushbutton PBT. In this situation, a high level pulse on the output 70 applied to terminal S of FF1 does not stop the clock 32 because the output Q of FF1 is already conducting a high level signal (see FIG. 5). However, the high level pulse applied to input C of FF2 reverses the output pulse conducted by its output Q and $\overline{Q}$, which reverses the direction of the counter 28 regardless of the direction in which it is counting prior to the operation of the pushbutton PBT.

For example, assuming that the counter 28 is counting upwardly prior to the operation of the pushbutton PBT, the output of the gate 63 is reversed in response to the switching of the flip-flop circuit FF2 as caused by changing the level of the input signals to the gates 61 and 62 that are input to the gate 63. The counter then merely starts counting in a direction opposite to the direction it was counting prior to the reversal. In the event the reversal is made while the frequency is increasing; that is, when the counter 28 is counting in an upwardly direction, the system starts counting downwardly until the operator again depresses the pushbutton PBT to again reverse the direction of transfer; or until the counter 28 reaches a zero count and stops operation in the manner previously described. Assuming that the operator initiates a reversal while the counter 28 is counting downwardly, and the frequency pulses are decreasing, a reversal of the signal level on output Q and $\overline{Q}$ of FF2 results in the output signal level from the gate 63 changing to a high level signal for changing the direction of the counter in an upwardly direction.

During these repeated reversals, the gate 23 is controlled by the flip-flop circuit FF5 to change the level of the output pulse applied to the drivers 21A through 21D of the switching devices 14A through 14D in response to each change of direction in modulation, which is caused by the counter 28 reaching its maximum count of 999. Each time that the pushbutton PBT is operated, the flip-flop circuit FF2 changes the illumination of the lamps 81 and 82 to inform the operator of the direction toward which such transfer is occurring.

Figure 7:
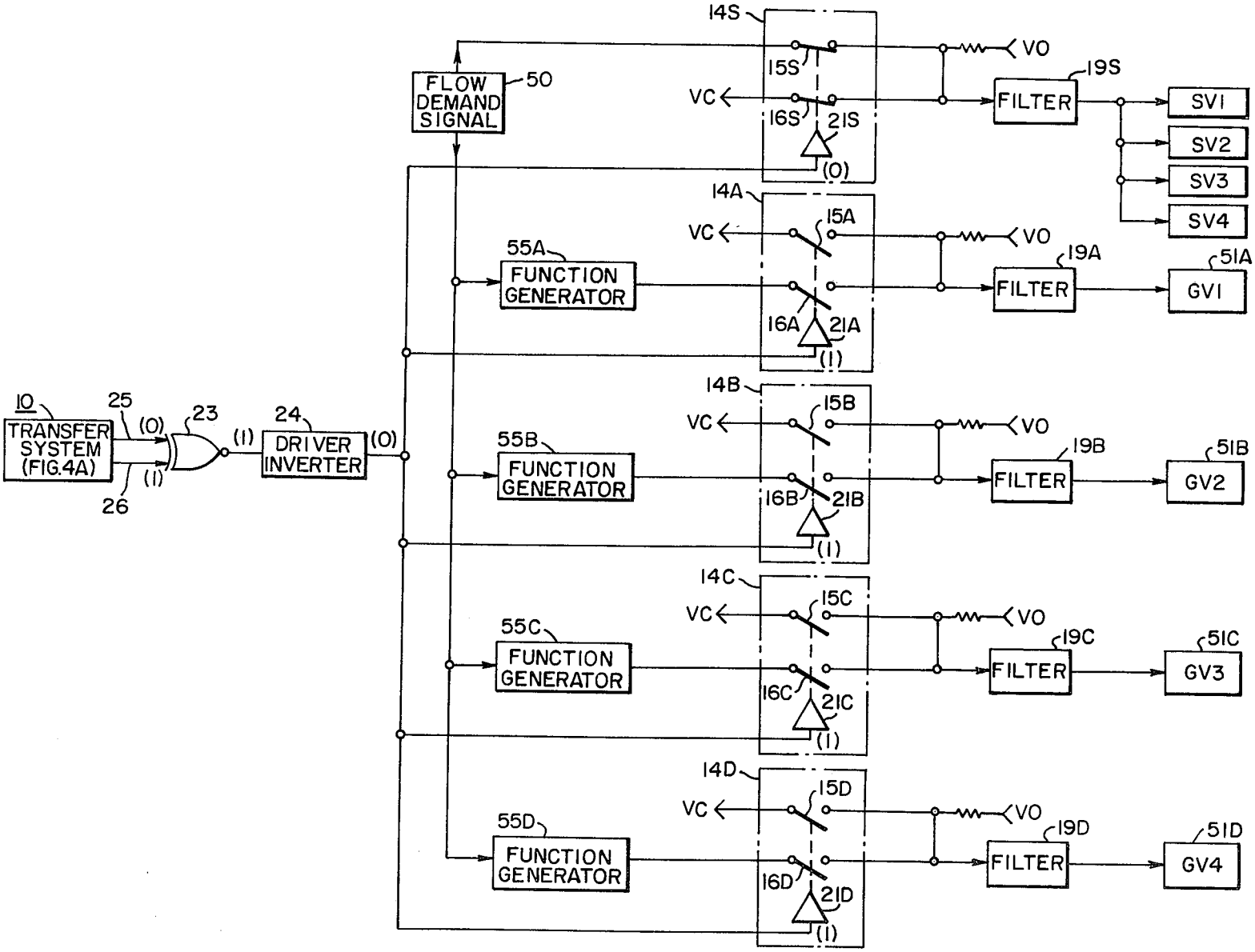
FIG. 7 is a schematic block diagram of a system for transferring the control of a turbine between two different groups of valves in accordance with another embodiment of the present invention.

With reference to FIG. 7, a system for transferring the operation of a steam turbine between a single and sequential mode wherein the stop valves SV1 through SV4 are utilized to control the turbine in a single mode; and the governor valves GV1 through GV4 are utilized to control the turbine in a sequential mode is shown.

The transfer system described and shown in FIG. 4 is connected through the exclusive NOR gate 23, the driver-inverter 24, and the switch actuating inputs 21A through 21D of the switches 14A through 14D respectively, in the same manner as described in connection with FIG. 4. A flow demand signal from the source 50 is connected through function generators 55A–55D, contacts 16A–16D of the switches 14A–14B respectively, and filtering devices 19A–19D to the actuating mechanism of the governor valves GVI through GV4 for operating their associated valves referred to by blocks 51A through 51B.

In the condition illustrated in FIG. 7, the valves SV1 through SV4 are responding to a signal from the source 50 through the closed contact 15S of the switch 14S. A voltage VO is connected to the input of filter 19S. A voltage VC is applied through closed contact 16S to the input of the filter 19S. The voltage VO is a bias voltage which operates the valves SV1 through SV4 to a full open position. The voltage VC is a bias voltage which operates the valves SV1 through SV4 to a fully closed position. When the switch 14S is in the condition as shown in FIG. 7 with both contacts 15S and 16S closed or conducting, the bias voltage VO and VC are connected through contacts 16S, which cancels out their effect on the control of the valves SV1 through SV4. Thus, the valves are responding solely to the flow demand signal from the source 50 through closed contact 15S. Similarly, a valve open bias voltage VO is applied to the input of each of the filters 19A through 19D, and a valve closed bias voltage VC is applied to each of the filters 19A through 19D through contact 15A–15D, respectively, when the contacts are closed.

The flow demand signal from the source 50 is applied to the input of the filters 19A–19D, and through respective function generators 55A–55D when the contacts 16A–16D are in their conducting or closed condition. For the condition illustrated in FIG. 7, the valves GV1 through GV4 are fully open as controlled by the valve open bias signal VO. When the contacts 15A through 15D and 16A through 16D are closed or conducting, the valve closed bias signal is connected to cancel out the valve open bias signal for each of the valves GV1 through GV4. Therefore, the valves are being controlled by the flow demand signal from the source 50 through their respective function generators 55A through 55D. With the system operating in the single valve mode, a transfer to the sequential valve mode causes the frequency of the output pulses from the rate multiplier 27 of FIG. 4 to drive the switches 14A through 14D and 14S at the same frequency as the output pulses. During the first portion of the cycle, as the frequency is being increased in accordance with the counting up of the counter 28, the voltage VO is being averaged with the flow demand signal from the source 50 by the filter 19S to gradually change the signal level at its output toward the level of the valve open bias signal. Simultaneously, the switches 14A through 14D are operated to follow such frequency to average more and more of the signal from the function generators 55A through 55D with the valve open signal. Thus, during the first portion of the transfer, the valves SV1 through SV4 are gradually opening to their full open position as the frequency increases; and the valves GV1 through GV4 are gradually being operated toward the signal level from the function generators 55A through 55D as the closing frequency of the contacts 15 and 16 for each of the switches 14A through 14B increase. Thus, during the first portion of the transfer, the contacts of each of the switches are opening at the increasing frequency rate. During the final portion of the transfer, as previously described, the frequency of the output pulses is being modulated downwardly; and the closing of the contacts 15S and 16S follow the frequency of the pulses from the gate 23. During the final portion of the transfer for the governor valves GV1 through GV4, the opening of the contacts 15 and 16 for the switches 14A through 14D follow the frequency of the pulses generated by the rate multiplier 27 (FIG. 4). Thus, during this final portion of the transfer, less and less of the flow demand signal is being averaged by the filter 19S; and less and less of the valve open signal VO is being averaged with the signal at the output of the generators 55A through 55D. This continues in the same manner as previously described, until the transfer is complete; at which time, both contacts of the switch 14S are in an open position so that the valve open bias voltage VO is applied to the operating mechanism of the stop valves SV1–SV4. The switches 14A through 14D are in their closed position so that the flow demand signal is being steadily applied through the closed contacts 16H through 16D. The valve open bias signal VO is cancelled out by the valve closed bias signal VC through closed contacts 15A–15D. For transferring back from sequential to single, the system operates the same, except, in a reverse direction with respect to the conducting of the gate 23, as described in connection with FIG. 4.

Figure 8:
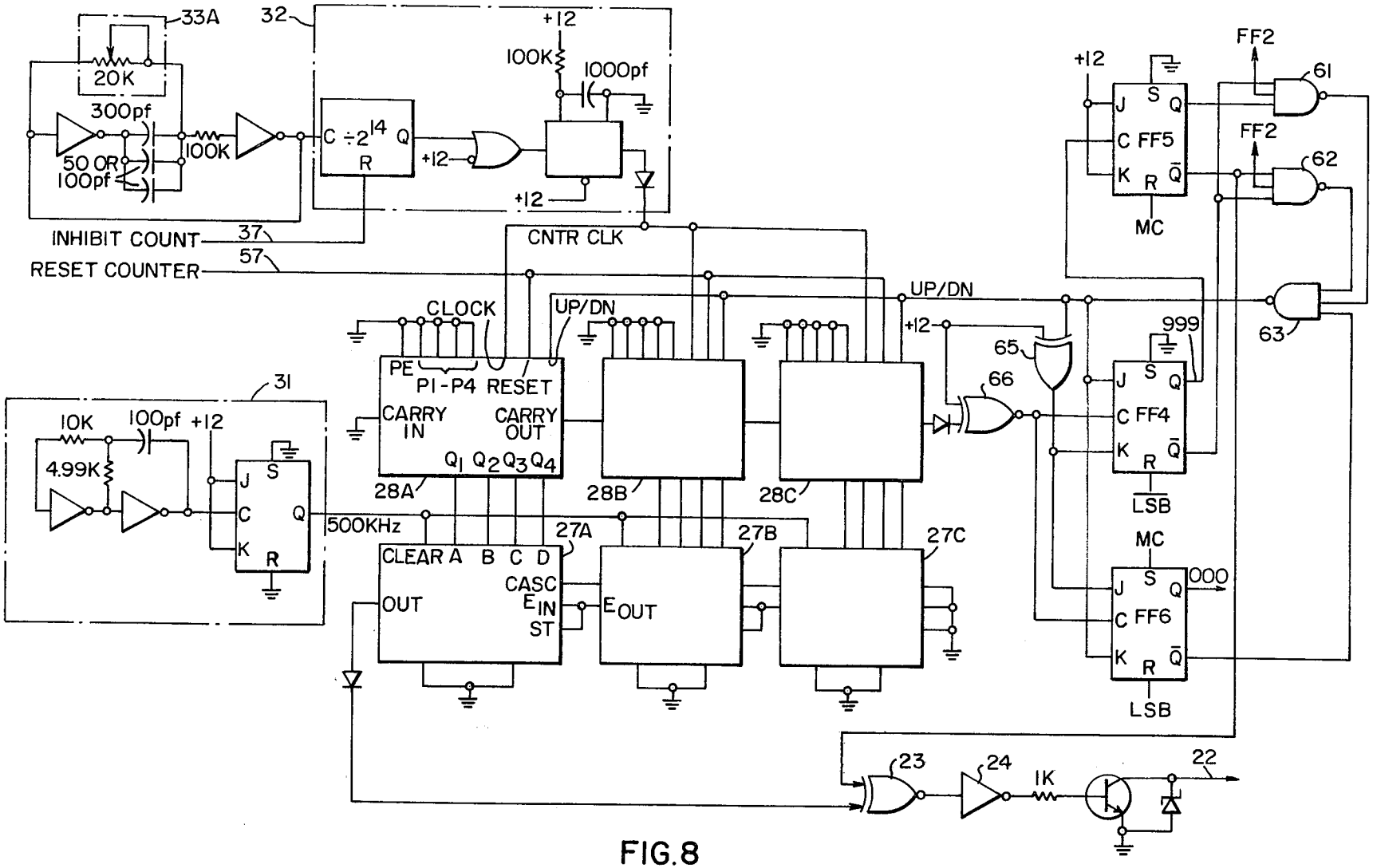
FIGS. 8 through 10 inclusive illustrate schematically the actual arrangement of the various components of the system of the present invention on individual digital cards.
Figure 9:
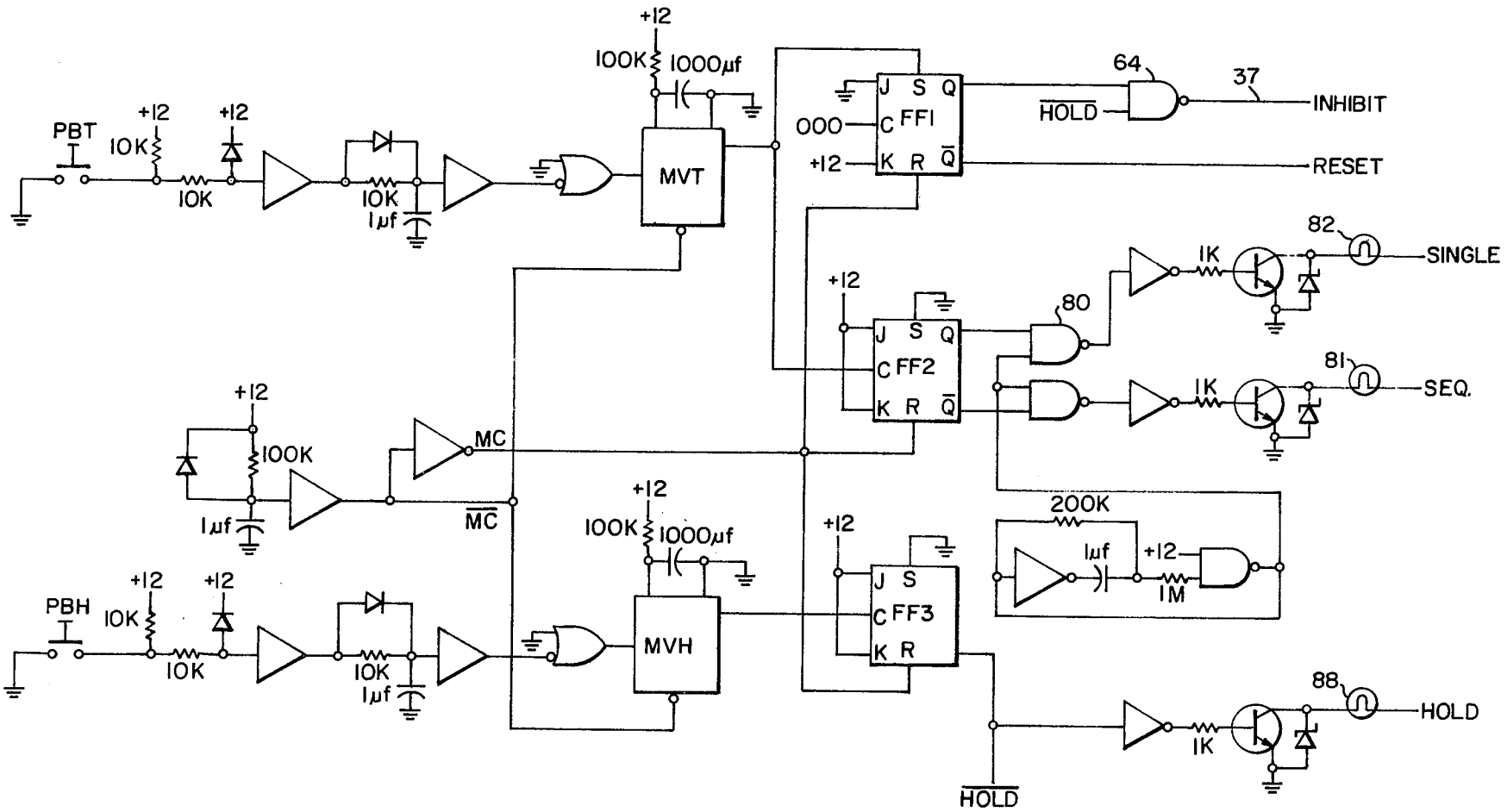
Figures 10, 11:
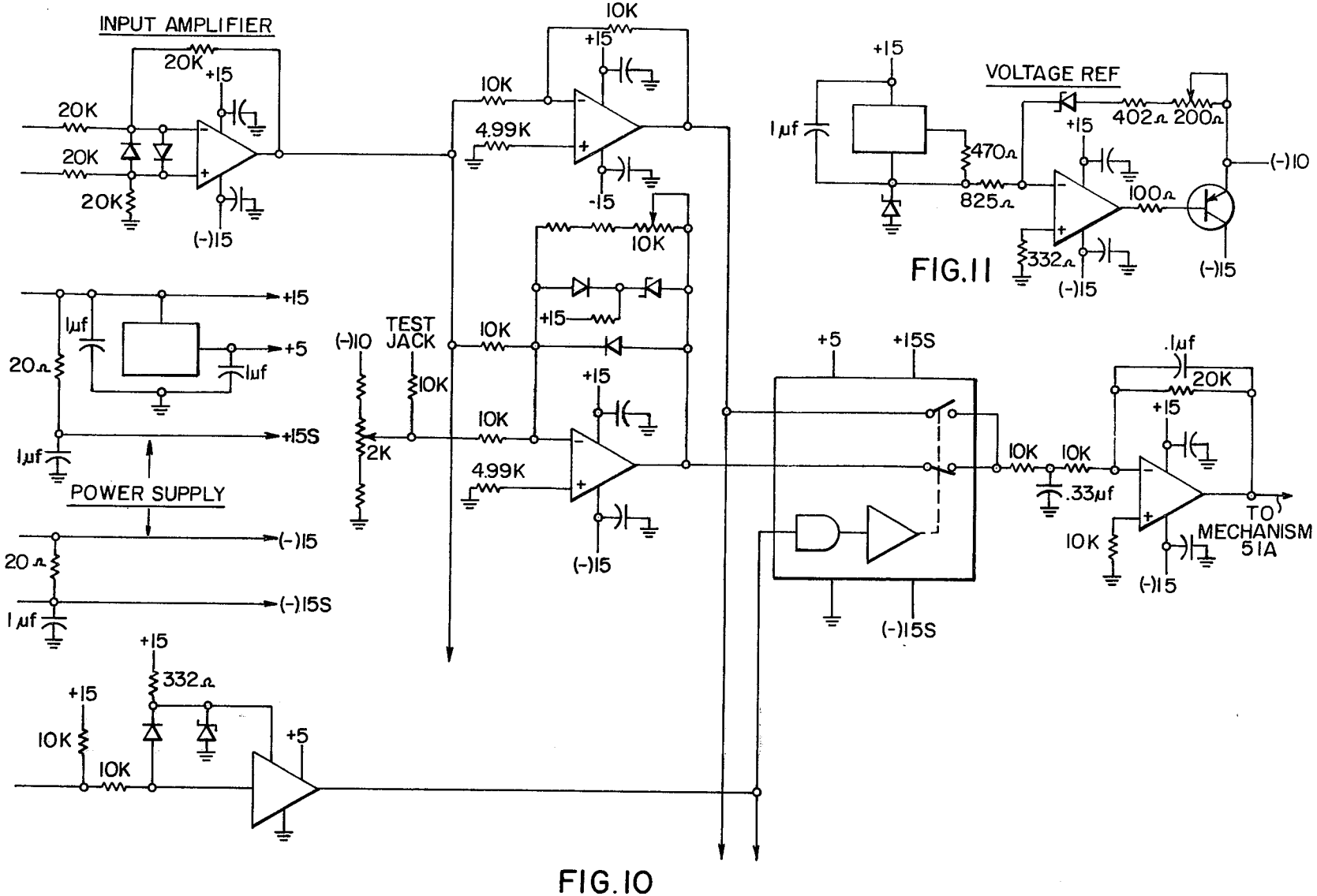
FIG. 11 is a schematic illustration of the voltage reference of the system of the present invention.

FIGS. 8, 9 and 10 shown actual arrangement of the various components on three individual digital cards. The major components of the system as shown in FIGS. 8, 9 and 10 bear similar reference numerals as the components in FIGS. 1 and 4. The details of the circuitry shown in FIGS. 8, 9 and 10 which have not been described in connection with the description of FIGS. 1 through 4 form no part of the present invention, and are considered to be common circuit techniques that would be well known to anyone skilled in the art. However, FIGS. 8 through 10 have been included to illustrate the additional advantages of the invention with respect to its adaptability to implementation by digital integrated circuitry and will enable anyone skilled in the art to readily implement the system of the invention.

Although each of the digital electronic components are well known in the art, and have been in use or described in printed publications for more than a year prior to the filing of this application, the following components have been found satisfactory in an actual reduction to practice of the invention. The counter 28 may be one of the models MC14510, which is a BCD up/down counter manufactured by Motorola Semiconductors. The rate multiplier 27 may be one of the models MC14527, which provides an output pulse rate based upon the BCD counter input number manufactured by Motorola Semiconductors. The switch 14 may be one of the models DG188, which is a two-channel high speed driver with a single pole, single throw junction field effect transistor switch manufactured by Siliconix Incorporated. The monostable multivibrator MVT or MVH may be one of the models MC14528 which provides the function of a dual, retriggerable, resettable multivibrator manufactured by Motorola Semiconductors. The J-K flip-flop devices FF1–FF6, may be one of the models CD4027 having set and reset capability manufactured by RCA. The adjustable timer may be one of the models MC14536 manufactured by Motorola Semiconductors.

It is understood that different components and types of components may be substituted for the described components; and different circuit arrangements can be designed in practicing the invention. It is further understood that the present invention can be implemented in any digital computing machine.

In summary, the present invention provides improved digital transfer system and method which permits the adjustment of the sequencing of the valves for the sequential mode of operation to be performed in the same manner as is presently known. Also, the system permits an independent signal voltage level for each valve control mechanism for a unit flow demand. Further, such a system permits fast response to any flow demand changes during signal transfer and also during normal operation when a transfer is not being effected. Lengthy transfer times can be achieved and adjusted over a wide range without deleterious effects on the gradual change of the signal level from one control mode of operation to the other. Low cost filter components may be used for filtering the high frequency signals; and many reversal of operations can occur at any point in the system without in any way effecting its reliable operation. Also, the system adapted readily to integrated circuitry.

It is to be understood that in connection with the broad definition of FIG. 1, that the arrangement of various components described as included in the FIG. 1 block diagram may differ from that described herein. Such description and grouping of components is made merely to facilitate an understanding and description of the present invention. Also the number of incremental frequency changes occurring each portion of the transfer operation has been described as including a certain maximum number, such as 999, it is understood that such counter may operate either to a low or a high maximum number; and the frequency of the rate multiplier may be either higher or lower than as described for each incremental count depending upon the specific application of the system. Other modifications will be apparent to those of ordinary skill in the art which will in no way depart from the spirit of the invention and which will fall within the scope of the claims.

What is claimed is:

1. A system for transferring control of a steam turbine between a single and a sequential mode of operation, said system comprising a plurality of steam inlet valves;

means to generate first control signals for operating predetermined steam inlet valves to control the flow of steam in a sequential mode;

means to generate second control signals for operating predetermined steam inlet valves to control the flowing steam in the single mode;

means when operated to initiate a transfer from the sequential mode to the single mode of operation and vice versa;

switching means operable to a first condition and a second condition, said switching means connecting the first control signals to the predetermined steam inlet valves when in the first condition and connecting the second control signals to the predetermined steam inlet valves when in the second condition;

means responsive to the operation of the transfer initiating means when the switching means is in the first condition to operate the switching means from the first to the second condition repetitively at a successively increasing frequency to a predetermined maximum frequency during a first portion of each transfer from the sequential to single mode;

means responsive to the operation of the transfer initiating means when the switcing means is in the second condition to operate the switching means from the second to the first condition repetitively at a successively increasing frequency to a predetermined maximum frequency during a first portion of each transfer from the single to the sequential mode;

means to operate the switching means repetitively at a sucessively decreasing frequency during the final portion of each transfer to the opposite condition of that to which the switching means is operated at an increasing frequency during the first portion of each transfer; and filtering means to average the first and second repetitive control signals throughout the transfer, whereby the control signal applied to the predetermined valves gradually changes from either the first to the second or the second to the first control signal during the transfer.

2. A system according to claim 1 wherein the predetermined steam inlet valves for the single and sequential valve modes are the same valves.

3. A system according to claim 2 wherein the predetermined steam inlet valves for the single and sequential valve modes are different valves.

4. A system for transferring control of a steam turbine between a full arc and a partial arc mode of operation, said system comprising:

a plurality of valve means for controlling the flow of steam to the turbine;

a first control signal for controlling the valve means to admit steam in a partial arc mode;

a second control signal for controlling the valve means to admit steam in a full arc mode;

a switch means operable to a first condition to connect the first signal to operate the valve means and operable to a second condition to connect the second signal to operate the valve means, said switch including operating means responsive to a driver signal of a first level to change the switch means from the first to the second condition and a driver signal of a second level to change the switch from the second to the first condition;

gating means having at least one output connected to the switch operating means to conduct a first level driver signal in response to a first predetermined input condition, and to conduct a second level driver signal in response to a second predetermined input condition;

means when operated to initiate a transfer of control from the full arc to the partial arc mode of operation and vice versa;

a pulse generating means having an output to produce at said output a series of electrical pulses, said generating means including means responsive to the operation of the transfer initiation means to modulate the frequency of the pulses in an increasing direction toward a predetermined maximum frequency and to modulate the frequency of the pulses in a decreasing direction from the predetermined maximum frequency, said output being connected to the input of the gating means;

means governed by a first input condition of the gating means prior to the operation of the transfer initiating means to cause each pulse from the pulse generating means to operate the gating means to conduct a first level driver signal and to conduct a second level driver signal in the absence of each pulse during the increasing frequency modulation of the pulses and to cause each pulse from the pulse generating means to conduct a second level driver signal and to conduct a first level driver signal in the absence of each pulse during the decreasing modulation of the pulses;

whereby the frequency of the second control signal is modulated in an increasing direction during the first portion of the transfer period and the frequency of the first control signal is modulated in a decreasing direction during the final portion of the transfer period at times when a transfer is initiated from the first control signal to the second control signal.

5. A system according to claim 4 wherein the pulse generating means includes a digital counter operative to produce at its output a series of signals at predetermined spaced time intervals corresponding to a succession of counts, and a rate multiplier connected to the output of the digital counter to produce at its output said series of electrical pulses having a different frequency in accordance with each output count of the counter.

6. A system according to claim 5 further including means connected to the digital counter to vary the rate of the output signals from the counter; whereby the time of each successive different frequency of the rate multiplier is variable to vary the period of transfer between the sequential and single mode of operation.

7. A system according to claim 5 wherein the counter produces an output signal at a predetermined maximum count, and the pulse generating means responds to said output signal to reverse the direction of the counter to change from an increasing to a decreasing frequency.

8. A system according to claim 4 wherein each switch means is a single pole, single throw junction field effect transistor switch with a two-channel high speed driver.

9. A system for transferring the control of a steam turbine between a single and sequential mode of operation and vice versa; comprising a plurality of steam inlet valves each operative to a position corresponding to the amplitude of an electrical signal, means to generate an electrical signal having an amplitude corresponding to a total steam flow demand for the plurality of valves, means governed by the total demand signal to generate for each valve a valve position signal to control the flow of steam through predetermined ones of the valves in a sequential mode, means governed by the total demand signal to generate for each valve a valve position signal to control the flow of steam through predetermined ones of the valves in the single mode, an up/down digital counter operative when activated in one direction to generate at its output a series of spaced signals, each signal corresponding to a binary coded number that successively increases in value to a predetermined maximum, and operative when activated in the other direction to generate at its output a series of spaced signals, each signal corresponding to a binary coded number that successively decreases in value to a predetermined minimum, a rate multiplier connected to the output of the digital counter to generate a series of pulses that correspond in frequency to each binary coded signal, whereby the frequency incrementally increases as the counter counts in one direction and incrementally decreases as the counter counts in the other direction, a first gating means operatively connected to the counter to activate the counter first in the one direction to a maximum count and then in the other direction to a minimum count, a second gating means connected to the output of the rate multiplier and the first gating means operative to produce one or the other of two distinct signals in response to each output pulse during the operation of the counter in one direction and to produce one or the other of two distinct signals in response to each output pulse during the operation of the counter in the other direction, switching means responsive to the one distinct signal to conduct one of the sequential or single control signals to operate the predetermined valves and responsive to the other distinct signal to conduct the other of the sequential or single control signals to operate the predetermined valves, means to initiate a transfer between the single and sequential mode, means responsive to the transfer initiating means at times when the switching means is responding to the one distinct signal to operate the second gating means to produce the other distinct signal in response to each output pulse from the rate multiplier while the counter is counting in one direction, means responsive to a count corresponding to the maximum count of the counter to operate the second gating means to produce the one distinct signal in response to each output pulse from the rate multiplier while the counter is counting in the other direction, and means reponsive to a minimum count of the counter to deactivate the counter to cease the generation of the series of pulses by the rate multiplier, whereby the second gating means is producing the other distinct signal upon the cessation of the pulse generation.

10. A system according to claim 9 further comprising a filtering means connected to the output of the switching means to average the frequency modulated control signals during the transfer.

11. A system according to claim 10 wherein each complete transfer between single and sequential mode corresponds to a predetermined number of successive counter outputs, said counter is operative to produce the successive counts at equally spaced time intervals, and said system further comprises, means to vary the time between each successive count, whereby the time for a complete transfer is varied between a predetermined minimum and a predetermined maximum period.

12. A system according to claim 10 further comprising, means when activated to suspend the operation of the counter, whereby the valves are controlled by an averaged signal having an amplitude in accordance with the frequency of the distinct signals at the time of suspension of the operation.

13. A system according to claim 10 further comprising means when activated to reverse the direction of the activated counter, whereby the frequency of operation of the switching means and the signal produced by the second gating means is reversed to reverse the transfer to the opposite control signal from that toward which such transfer is occurring prior to such activation.

14. A system according to claim 10 wherein the means responsive to the transfer initiating means includes a plurality of digital flip-flop circuit devices.

15. A system according to claim 10 further comprising, a single power source, and circuit means responsive to the activation of the single power source to govern the second gating means to conduct the same distinct signal.

16. A system according to claim 10 wherein the predetermined maximum frequency rate of the rate multiplier at the maximum count of the counter is in the neighborhood of five hundred kilohertz.

17. A system according to claim 10 wherein the number of individual counts of the counter generated during a complete transfer is in the neighborhood of two thousand.

18. A system for transferring the control of a steam turbine between a single and sequential mode of operation and vice versa; comprising a first plurality of steam inlet valves each operative to a position corresponding to the amplitude of an electrical signal for controlling the steam in a single mode;

a second plurality of steam inlet valves each operative to a position corresponding to the amplitude of an electrical signal for controlling the steam in a sequential mode;

means to generate first control signals for controlling variably the first plurality of valves in the single mode;

means to generate second control signals for variably controlling the second plurality of valves in the partial arc mode;

means to generate first bias signals for opening the first plurality of valves at times when the steam flow is controlled by the second plurality of valves and to generate second bias signals for opening the second plurality of valves at times when the steam flow is controlled by the first plurality of valves;

means when operated to initiate a transfer from the single mode to the sequential mode and vice versa;

switching means operable to a first condition to connect the first control signals to the first plurality of valves and the first biasing signal to the second plurality valves, said switching means operable to a second condition to connect the second control signals to the second plurality of valves and the first biasing signal to the first plurality of valves;

means responsive to the operation of the transfer initiating means when the switching means is in the first condition to operate the switching means from the first to the second condition repetitively at a successively increasing frequency to a predetermined maximum frequency during a first portion of each transfer from the sequential to single mode;

means responsive to the operation of the transfer initiating means when the switching means is in the second condition to operate the switching means from the second to the first condition repetitively at a successively increasing frequency to a predetermined maximum frequency during a first portion of each transfer from the single to the sequential mode;

means to operate the switching means repetitively at a successively decreasing frequency during the final portion of each transfer to the opposite condition of that to which the switching means is operated at an increasing frequency during the first portion of each transfer; and filtering means to average the first and second repetitive control signals throughout the transfer, whereby the control signal applied to the first or second plurality valves gradually changes from either the first to the second or the second to the first control signal during the transfer.

* * * * *